US011882926B2

(12) United States Patent
Pires et al.

(10) Patent No.: US 11,882,926 B2
(45) Date of Patent: Jan. 30, 2024

(54) ADJUSTABLE APPLICATOR

(71) Applicant: ZEN DESIGN SOLUTIONS LIMITED, Kowloon (HK)

(72) Inventors: Leo Clifford Pires, Basking Ridge, NJ (US); Roger Hwang, Maple (CA); Rahul Bose, New Delhi (IN); Manisha Kohli, New Delhi (IN); Iti Seth, Faridabad (IN); Rajesh Deswal, Rohtak (IN)

(73) Assignee: ZEN DESIGN SOLUTIONS LIMITED, Kowloon (HK)

( * ) Notice: Subject to any disclaimer, the term of this patent is extended or adjusted under 35 U.S.C. 154(b) by 785 days.

(21) Appl. No.: 15/687,742

(22) Filed: Aug. 28, 2017

(65) Prior Publication Data

US 2018/0055205 A1 Mar. 1, 2018

(30) Foreign Application Priority Data

Aug. 31, 2016 (IN) ..... 201611029738

(51) Int. Cl.

| | |
|---|---|
| ***A46B 7/02*** | (2006.01) |
| ***A46B 9/02*** | (2006.01) |
| ***A46B 9/00*** | (2006.01) |
| ***A45D 34/04*** | (2006.01) |
| ***A45D 40/26*** | (2006.01) |

(52) U.S. Cl.

CPC ..... *A46B 7/02* (2013.01); *A45D 34/046* (2013.01); *A45D 40/265* (2013.01); *A45D 40/267* (2013.01); *A46B 9/005* (2013.01); *A46B 9/021* (2013.01); *A46B 2200/1053* (2013.01)

(58) Field of Classification Search

CPC .. A45D 34/042; A45D 34/043; A45D 34/045; A45D 34/046; A45D 40/262; A45D 40/264; A45D 40/265; A45D 40/267; A46B 2200/106; A46B 2200/1053; A46B 2200/1046; A46B 9/021; A46B 9/10; A46B 7/02; A46B 7/023; A46B 7/026; A46B 9/005

USPC ..... 132/218, 313

See application file for complete search history.

(56) References Cited

U.S. PATENT DOCUMENTS

| | | | | |
|---|---|---|---|---|
| 3,998,235 A | | 12/1976 | Kingsford | |
| 4,446,880 A | * | 5/1984 | Gueret | A45D 40/265 132/218 |
| 5,722,436 A | | 3/1998 | Vandromme et al. | |
| 6,345,626 B1 | * | 2/2002 | Bouix | A45D 40/267 132/218 |

(Continued)

*Primary Examiner* — Jacqueline T Johanas
*Assistant Examiner* — Sarah Woodhouse
(74) *Attorney, Agent, or Firm* — Patterson + Sheridan, LLP

(57) ABSTRACT

An adjustable applicator for applying cosmetic, makeup, or personal care composition, the adjustable applicator includes an applicator head. The applicator head comprises at least two applicator members each comprising a plurality of application elements and wherein when there is a relative axial displacement of one of the at least two applicator members, the other of the at least two applicator members is deformed radially. The applicator head may be used for applying cosmetic, makeup, or personal care composition to keratin materials chosen from the skin, the lips and the eyelashes, or hair of the human. The cosmetic or care product includes liquid or viscous cosmetics such as for mascara, lip stick, hair color, skin care and like products.

20 Claims, 8 Drawing Sheets

(56) References Cited

U.S. PATENT DOCUMENTS

| | | | | |
|---|---|---|---|---|
| 6,725,495 | B1 * | 4/2004 | Habibi | A46B 7/10 132/120 |
| 8,539,963 | B2 * | 9/2013 | Pires | A45D 40/265 132/218 |
| 2005/0249539 | A1 * | 11/2005 | Habatjou | A45D 40/265 401/127 |
| 2006/0272667 | A1 * | 12/2006 | Wyatt | A45D 40/265 132/218 |
| 2010/0212682 | A1 * | 8/2010 | Pires | A45D 40/265 132/218 |
| 2014/0246043 | A1 * | 9/2014 | Befve | A46B 3/005 132/218 |
| 2015/0342322 | A1 * | 12/2015 | Lequeux | A45D 34/045 401/18 |
| 2016/0270514 | A1 * | 9/2016 | Pires | A45D 40/265 |
| 2018/0000228 | A1 * | 1/2018 | Crapet | A46B 9/021 |

* cited by examiner

ADJUSTABLE APPLICATOR

CROSS-REFERENCE TO RELATED APPLICATION

This application claims benefit of Indian Provisional Application Ser. No. 201611029738, filed on Aug. 31, 2016, which is incorporated by reference in its entirety.

BACKGROUND

Field of the Invention

The subject of the present disclosure is an adjustable applicator for applying cosmetic, makeup, or personal care composition to keratin materials chosen from the skin, the lips and the eyelashes, or hair of the human. The cosmetic or care product includes products such as for mascara, lip stick, hair color, skin care and like products.

Description of the Related Art

Various applicators for applying a substance are known. There are certain application areas where there is a requirement of curving the applicator as per user's convenience. Some such areas include application of mascara or in the cleaning of dental interstices.

Also, mascara, an important make-up accessory used to darken and define eyelashes to accentuate the eyes, is difficult to apply because of the target area of application. The eyelashes offer a very small application area, while being soft, flexible, delicate and in close proximity to very sensitive eye tissue. Therefore, a mascara product would be liked by the consumers when a right kind of applicator is provided to them for easy application as the overall consumer experience depends on both the product and on the applicator used to apply it.

Mascara applicators such as twisted wire mascara brushes and molded mascara applicators are known in the art. The flexibility and the bristle or tooth position characteristics of a majority of known mascara brushes or combs are fixed.

Also, mascara applicators should retain a sufficient quantity of mascara to avoid a need for overly-frequent reloading during application. Further, such applicators should be able to grip the lashes, separate them, extend them and/or curl them, depending on the type of makeup desired. Users may find it difficult to control the quantity of substance loaded onto the brush or comb of known applicators.

U.S. Pat. Nos. 3,998,235 and 5,722,436 describe applicators comprising applicator elements with a separation that may be adjusted by the user. In such applicators, the distance between the applicator elements is modified by applying a compressive force along the longitudinal axis of the applicator. Further, U.S. Pat. No. 6,345,626 describes an applicator comprising a plurality of independent disks suitable for being axially pressed together while the applicator is being withdrawn from the receptacle containing the substance to be applied.

There exists a need, prior to application and/or during use, to be able to modify an applicator to adapt to the shape, number, disposition, thickness, flexibility, and length of eyelashes or eyebrows of a person, to the rheology of the substance, and/or to the desired type of makeup.

SUMMARY

Accordingly, it is an object of the present disclosure to provide an adjustable applicator in which at least two distinct application methods which can be either combing or separating action can be adjusted to suit all users.

It is another object of the present disclosure to provide an adjustable applicator which enables a user to modify the spacing between application elements or feature bearing the application elements which will optimize the combing and separating action of the adjustable applicator.

To this end, the disclosure provides an adjustable applicator comprising an applicator head and wherein the applicator head is configured to adopt at least two configurations, namely a first configuration and a second configuration. In the first configuration, the applicator head is fully extended along a central longitudinal axis of the adjustable applicator and which also corresponds to a radially retracted position of at least one portion of the applicator head. The applicator head has a first diameter in the first configuration. In the second configuration, the applicator head is in a radially extended position, in which the at least one portion of the applicator head is radially deformed and overall height of the applicator head is altered. This produces a pronounced increase in the applicator head's diameter and the diameter alteration is at least at one point along a length of the applicator head. In the second configuration, the applicator head has second altered diameter which is distinct than the first diameter.

According to an aspect of the present disclosure, the applicator head comprises at least two applicator members. More particularly, the applicator head comprises a first applicator member and a second applicator member. According to a preferred embodiment, the first applicator member is an inner applicator member. Each of the at least two applicator members comprises a support body having an outer surface facing away from the central longitudinal axis. A plurality of application elements extend out from the outer surface of the support body of each of the at least two applicator members. Each of the first applicator member and a second applicator member comprises a distal end and a proximal end. When there is an axial displacement of one of the at least two applicator members, the other of the at least two applicator member is relatively deformed radially.

However, an embodiment where the applicator head comprises more than two applicator members is also contemplated.

According to an aspect of the present embodiment, one of the proximal ends and distal ends of the first applicator member and second applicator member do not have axial movement relative to each other, i.e. they are fixed to one another in such a manner that said ends of the first applicator member and second applicator member do not move independently of each other. However, other of the proximal and distal ends of the first applicator member and second applicator member have axial movement relative to each other. The first and second applicator members may be directly connected at their respective ends by screw, adhesive, bi-injection method or any other connecting means known in the art. In other alternate embodiments, the ends of the first and second applicator members may be indirectly connected to one another via a third part.

According to a preferred aspect of the present embodiment, the distal ends of the first applicator member and second applicator member do not have axial movement relative to each other, i.e. they are fixed to one another in such a manner that distal ends of the first applicator member and second applicator member do not move independently of each other. However, the proximal ends of the first applicator member and second applicator member have axial movement relative to each other, more particularly, the proximal end of the first applicator member is axially movable and the proximal end of the second applicator member is fixed so that it cannot move axially.

According to a further aspect of the present embodiment, the two applicator members are arranged to be movable relative to each other wherein the relative movement of the applicator members results in radial deformation of one of the applicator members. More specifically, when the first applicator member is moved axially towards the proximal end of the adjustable applicator, the distal end of the second applicator member is pulled along with the distal end of the first applicator member, however the proximal end of the second applicator member does not move, which results in radial deformation of the second applicator member due to compression stress exerted on it. Thus, the second applicator member is movable between a radially retracted position and a radially extended position. The second applicator member is in the radially extended position when the first applicator member is moved axially towards the proximal end of the adjustable applicator. The second applicator member is in the radially retracted position when the first applicator member is moved axially towards a distal end of the adjustable applicator.

According to another embodiment, at least a portion of the second applicator member is in the radially extended position when the first applicator member is moved axially towards the proximal end of the adjustable applicator.

According to an aspect of the present disclosure, the adjustable applicator comprises of an actuator, a cap, a hollow stem, a movable member, an inner rod and an applicator head.

According to an aspect of the present disclosure, the actuator causes the displacement of at least one applicator member relative to other applicator members and thereby varying the profile of applicator head of the adjustable applicator. The actuator is a dialer, however, the actuator may be a slider, a button or any other suitable actuator which is capable of exerting mechanical force through electronic or non-electronic means to cause axial movement of one of the at least two applicator members.

According to yet another aspect of the present disclosure, the support body of the second applicator member is tubular body with a hollow interior. Further, the support body includes at least two spaced slots extending substantially longitudinally thereon to define at least two longitudinal strips between them, and wherein the at least two longitudinal strips having plurality of application elements thereon. The at least two longitudinal strips are arranged along the central longitudinal axis but in other alternate embodiments, the at least two longitudinal strips may be arranged at an angle with the central longitudinal axis or may form a spiral around the central longitudinal axis.

According to another embodiment, the second applicator member is made up of two material having different physical properties or chemical properties for e.g.: a portion of the second applicator is made up of soft material and a portion of the second applicator is made up of hard material.

According to another embodiment, at least a portion of at least one strip of the second applicator member is made of a material softer/flexible than material of other portion of the strip. The softer/flexible portion of the strip of the second applicator member is in the radially extended position when the first applicator member is moved axially towards the proximal end of the adjustable applicator.

According to yet another aspect of the present disclosure, the first applicator member is mounted at least in part within the hollow interior of the second applicator member so as to expose the application elements of each of the first and second applicator members. More specifically, the first applicator member has an elongated body having a proximal end and a distal end. The first applicator member further comprises at least two longitudinal projecting strips projecting from the elongated body, and wherein each longitudinal projecting strip has at least one row of the application elements thereon. The at least two longitudinal projecting strips are arranged along the central longitudinal axis but in other alternate embodiments, the at least two longitudinal projecting strips may be arranged at an angle with the central longitudinal axis or may form a spiral around the central longitudinal axis.

The projecting strips have a shape corresponding to the slots of the second applicator member so that when the first applicator member is mounted at least in part within the hollow interior of the second applicator member, the projecting strips are placed in the respective slots such that projecting strips of the first applicator member and the strips of the second applicator member together form an outer applicator surface of the applicator head corresponding to the first configuration of the applicator head.

According to yet another aspect of the present disclosure, the applicator members are so arranged to expose the application elements of each of the first and second applicator member in an alternate fashion, i.e. at least one row of application elements of the first applicator member are placed adjacent to at least one row of application elements of the second applicator member in alternate fashion. In other words, the strips of the second applicator member alternate with projecting strips of the second applicator member around the central longitudinal axis of the applicator head.

This embodiment may, of course, be subject to many variations. Thus, the number of strips of the second applicator member may be higher than two, for instance, three, four, five, six, eight or any other number. The shape and disposition of the application elements can obviously be altogether different.

According to yet another aspect of the present disclosure, the application elements may be chosen from a group of application elements consisting of bristles, teeth, discs, ribs, and flocking.

According to yet another aspect of the present disclosure, at least one strip of the second applicator member is movable from a radially retracted position to a radially extended position. The radial gap is created between the first and second applicator members in the radially extended position of the second applicator member. In other words, the at least one strip of the second applicator member is relatively deformed radially outward to separate from the strip of the first applicator member in the radially extended position.

According to preferred embodiment, the second applicator member is made of material softer than the material of first applicator member. Preferably, the second applicator member is flexible and made of an elastomeric material. The first applicator member may be made from a harder plastic, metal, ceramic or similar type of material.

According to yet another aspect of the present disclosure, the proximal end of the first applicator member is connected to a distal end of the axially movable inner rod of the adjustable applicator. Whereas, the proximal end of the second applicator member is fixed to a distal end of the hollow stem of the adjustable applicator and wherein the stem is not axially movable. The hollow stem includes a cavity which houses the inner rod. The adjustable applicator also includes the actuator and the movable member and wherein, the rotation of actuator causes the axial displacement of the movable member. According to an embodiment, the actuator is a dialer but in other embodiments, the actuator may be a slider, a button or any other suitable actuator which causes axial movement of the first applicator member.

According to present embodiment, the cap is attached with the actuator such that the actuator is free to rotate with respect to the cap via a snap-fit system comprising an internal annular groove on the actuator that engages with a complementary external annular protrusion on the cap. The actuator can thus be turned by the user relative to the cap. However, any suitable engagement means may be employed that allows relative rotation between the actuator and cap.

Further, the lower portion of the cap is non-rotatably connected to a proximal portion of the stem. The stem may be attached to the cap of a gripping member by snap-fitment or by any other engaging means known in the prior art. Further, for non-rotatably locking the stem with the cap, there may be provided on the interfaces where the stem is joined to the cap, complementary longitudinal protrusions and positioning longitudinal grooves. For example, the outer surface of stem may include a plurality of longitudinal protrusions which is arranged to become in mating engagement with complementary grooves present at an inner surface of the cap or vice versa, for non-rotatable engagement. However, it is not beyond ambit of the present disclosure that any other non-rotatable engagement known in the art may be employed for locking any relative rotation between the stem and the cap. According to alternate embodiments, the stem and the cap may be integrally molded.

According to yet another aspect of the present disclosure, the movable member is rotatably connected to the cap by a threaded arrangement. The upper portion of the cap includes internal threads to connect to outer threads of the movable member. Movable member is connected to the actuator in a manner such that axial movement of the movable member is allowed but rotational movement with respect to actuator is prohibited. The actuator includes longitudinal guide protrusions at its inner surface for guiding axial movement of the movable member and for preventing movable member from rotating with respect to actuator, when the actuator is rotated. The movable member includes a catch which holds a proximal end of the inner rod. When the actuator is rotated, the movable member rotates with respect to cap and move axially due to screw engagement with the cap. The inner rod and the first applicator member are also displaced axially with movable member since inner rod is held by the movable member. Thus, when the actuator is actuated by rotation in first direction about a longitudinal axis, the movable member also rotates along with the actuator and moves up on the threads of cap and thereby results in the upward movement of the inner rod in the longitudinal direction. The movement of inner rod in the longitudinal direction results in the displacement of the first applicator member in the longitudinal direction, and the first applicator member is pulled along with the distal end of the second applicator member to decrease the overall height of the applicator head and which also results in radial extension/blowing of the second applicator member and producing a pronounced increase in the applicator head's diameter. The applicator head achieves the second configuration which corresponds to radially extended position of the second applicator member. The application in this state of the applicator head gives a better separation and curling in case of mascara. The actuator when rotated in a second direction reverse to first direction brings the applicator head to its initial first configuration which corresponds to radially retracted position of the second applicator member. It will thus be understood that the applicator may be used by a person either in the minimum diameter configuration or in the maximum diameter configuration. If the user wishes to return from the radially extended position to that of radially retracted position, the user only has to rotate the actuator so that the inner rod moves downwards and the second applicator member resume its elongated and radially retracted position with initial diameter.

According to another aspect of the present disclosure, the inner rod is connected to the movable member in such a way that when the movable member rotates the inner rod does not rotate along with the movable member.

According to another aspect of the present disclosure, the inner rod is connected to the movable member in such a way that when the movable member rotates the inner rod also rotate along with the movable member.

According to yet another aspect of the present disclosure, the inner rod and first applicator member may be formed integrally.

According to yet another aspect of the present disclosure, the stem and second applicator member may be formed integrally.

According to another aspect of the present disclosure, when the actuator is rotated with respect to the cap, the inner rod moves longitudinally with respect to the stem which cause variation in the profile of the applicator head as explained above. When a suitable adjustment of the profile of the applicator head has been made it will be retained while the applicator head is used. The adjustment is retained until the user intentionally rotates the actuator and the cap with respect to each other once again to achieve a different adjustment.

According to yet another embodiment of the present disclosure, the inner rod and the stem may have circular or non-circular transverse cross-sections.

According to yet another embodiment of the present disclosure, one or more annular ribs and sealing O-rings are configured around the inner rod so that the inner rod interfaces tightly against an inner wall of the stem. The annular ribs and the sealing O-rings prevent the product from leaking and ensure steady, smooth, and noiseless extension of the inner rod along the stem.

According to yet another aspect of the present disclosure, at least one longitudinal strip of the second applicator member includes at least one protrusion that projects in the adjacent slot of the second applicator member. A compression stress is exerted on the second applicator member when the first applicator member is displaced axially towards the proximal end of the adjustable applicator, a mechanical interference between the first and the second applicator member is generated due to interference between the at least one protrusion and the projecting strip of the first applicator member. The mechanical interference produces a resultant force in radial direction on the second applicator member, which guarantees the separation between the longitudinal strips of the second applicator member and the projecting strips of the first applicator members in radial orientation/direction in spite of being impregnated by a cosmetic product. In the first configuration, the at least one protrusion is located below a proximal end of one of the at least two longitudinal projecting strips of the first applicator member; and in the second configuration of the applicator head, the at least one protrusion is located laterally to the at least two longitudinal projecting strips of the first applicator member.

According to yet another aspect of the present disclosure there is provided a container comprising a receptacle and the adjustable applicator as described above. The receptacle is of cylindrical cross section extending in the longitudinal direction; however, the receptacle can take any suitable shape. The receptacle is closed by the cap by way of a threaded arrangement; however, any other suitable lock and key arrangement may be used to close the receptacle. The actuator, the cap, and the receptacle are of substantially same cross section so as to align along a common axis when fastened to each other in the closed position of the container.

The applicator member is secured to the stem and intended for being inserted in said receptacle in order to be loaded with the product to be applied.

The receptacle has a closed end and an open end in the form of a neck thereby defining a cavity for holding the product. The neck of the receptacle is provided with an external thread intended for cooperating with a complementary internal thread carried by a cap in its lower portion, allowing the receptacle to be closed by screwing.

According to yet another aspect of the present disclosure, for some cosmetic products, such as mascara or a lip gloss, it is preferable to provide a wiper positioned into the neck of the receptacle to wipe excess product from the adjustable applicator as the adjustable applicator is withdrawn from the receptacle. The wiper is preferably made of an elastomeric plastic material. The wiper may be one time snap fitted to the neck of the receptacle, however, the wiper may be fitted onto the neck of the receptacle by any other suitable arrangement.

According to an alternate embodiment of the present disclosure, both the applicator members may blow relative to each other and wherein one of the applicator members may blow more relative to other applicator member.

A user may utilize the container as described in above embodiments for application of a product. Moreover, the adjustable applicator of the container allows the user to vary the profile of the applicator head.

The materials suitable for forming the receptacle, the inner rod, the cap, actuator, stem and the movable member may be formed of plastic material such as polypropylene, acrylonitrile butadiene styrene, polyacetal or any other suitable polymeric material. In alternate embodiments, the receptacle may be made of glass or metal. In alternate embodiments, the inner rod may be made of metal, alloy or ceramic material. The material for forming wiper could be low-density polyethylene. The aforementioned materials for forming various parts of the container of the present disclosure are an example, however other suitable materials may also be used. Depending upon the substance being used in the receptacle, a variety of sizes and shapes of the applicator heads/members can be utilized. It could have a shape other than cylindrical such as ovular, tapered or any other suitable shape.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings.

Figure 1:
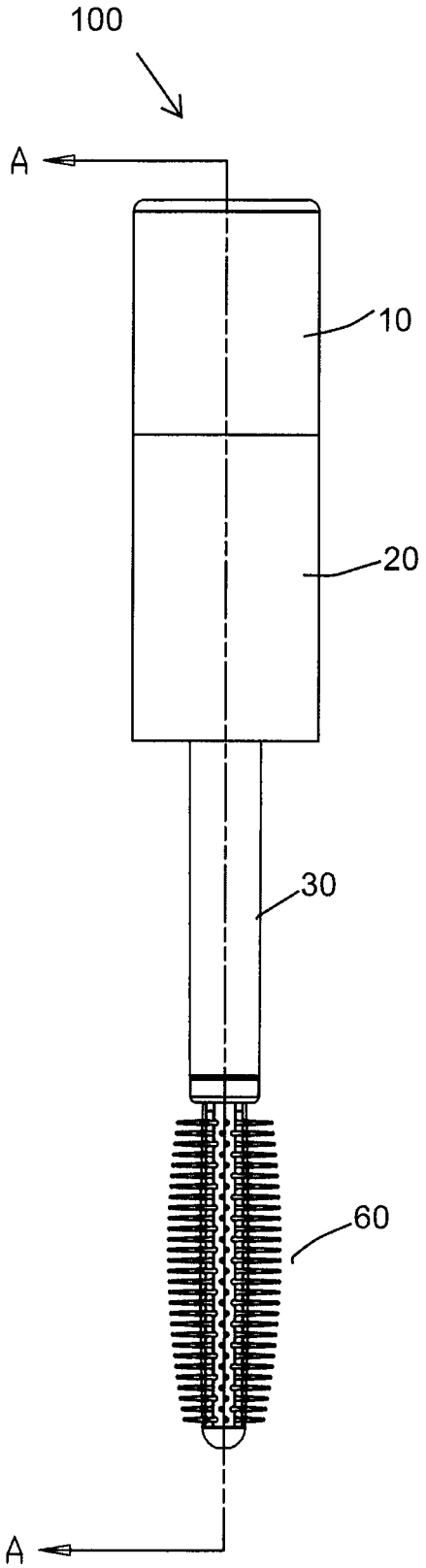
FIG. 1 illustrates a front view of an adjustable applicator in a first configuration according to the present disclosure.

To facilitate understanding, identical reference numerals have been used, where possible, to designate identical elements that are common to the figures. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 2:
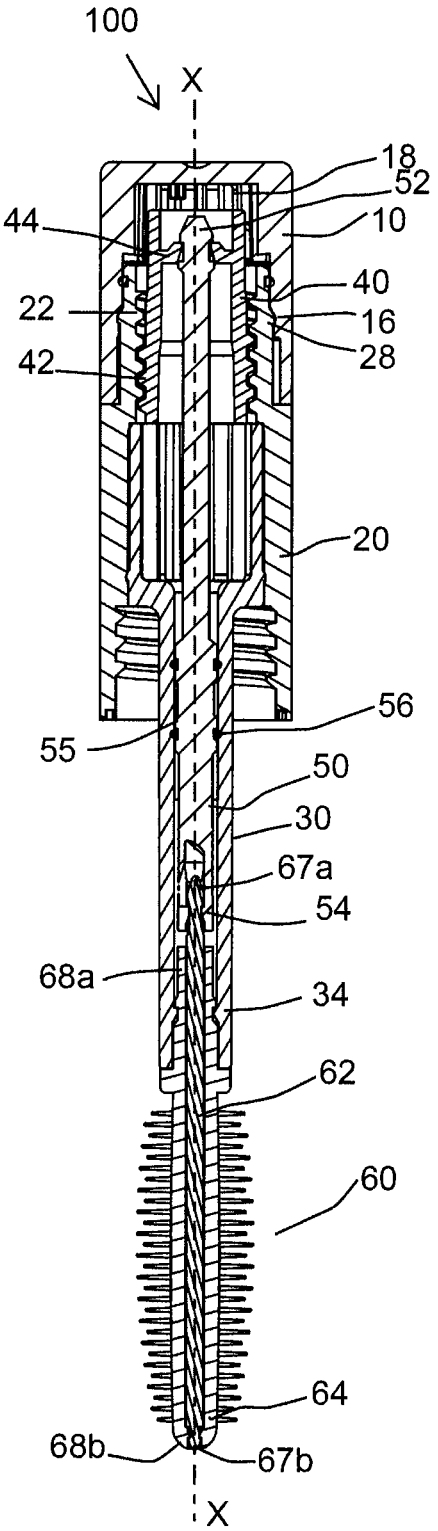
FIG. 2 illustrates a cross-sectional view taken along an axis A-A of the adjustable applicator of FIG. 1.
Figure 5:
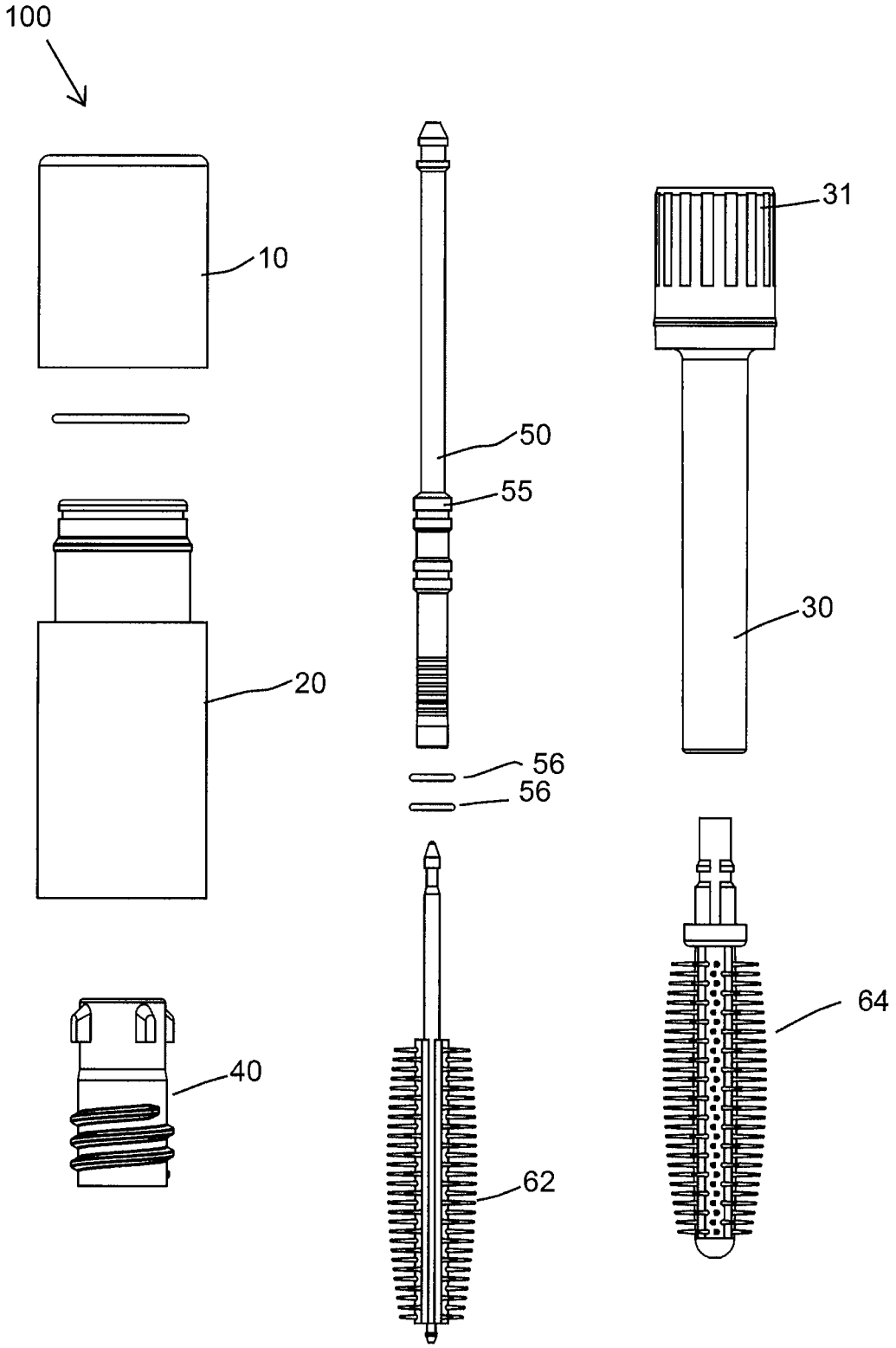
FIG. 5 illustrates an exploded view of the adjustable applicator of FIG. 1.

FIGS. 1, 2 and 5 illustrate an embodiment of the present disclosure showing a front view of an adjustable applicator 100. The adjustable applicator 100 comprises of an actuator 10, a cap 20, a hollow stem 30, a movable member 40, an inner rod 50 and an applicator head 60. The applicator head 60 comprises of at least two applicator members 62 and 64.

As shown in FIGS. 1 and 2, the adjustable applicator 100 comprises of at least two applicator members 62, 64. However, an embodiment where the adjustable applicator 100 comprises more than two applicator members is also contemplated.

According to present embodiment, the actuator 10 causes displacement of at least one of the two applicator members 62, 64 relative to other of the two applicator members 62, 64 and thereby varying the profile of the applicator head 60 of the adjustable applicator 100. The actuator 10 as shown in the FIGS. 1-4, is a dialer however, the actuator 10 may be a slider, a button or any other suitable actuator which causes axial movement of one of the at least two applicator members 62 and 64.

As seen in FIG. 1, the applicator head 60 comprises a first applicator member 62 and a second applicator member 64. According to a preferred embodiment, the first applicator member 62 is a central/inner applicator member.

Figure 3:
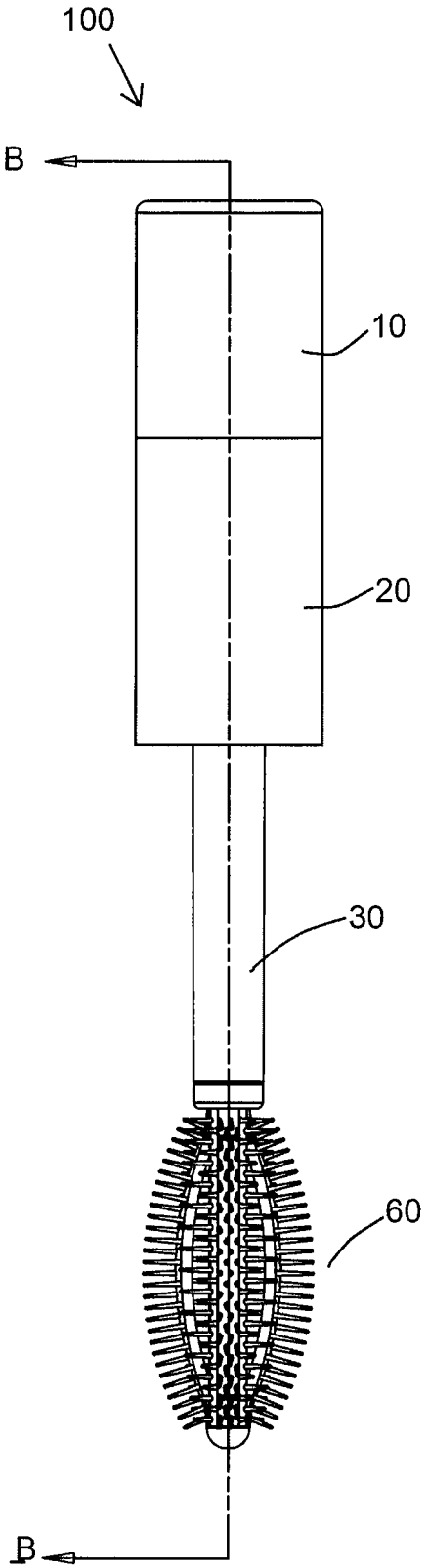
FIG. 3 illustrates a front view of the adjustable applicator of FIG. 1 in a second configuration according to the present disclosure.
Figure 4:
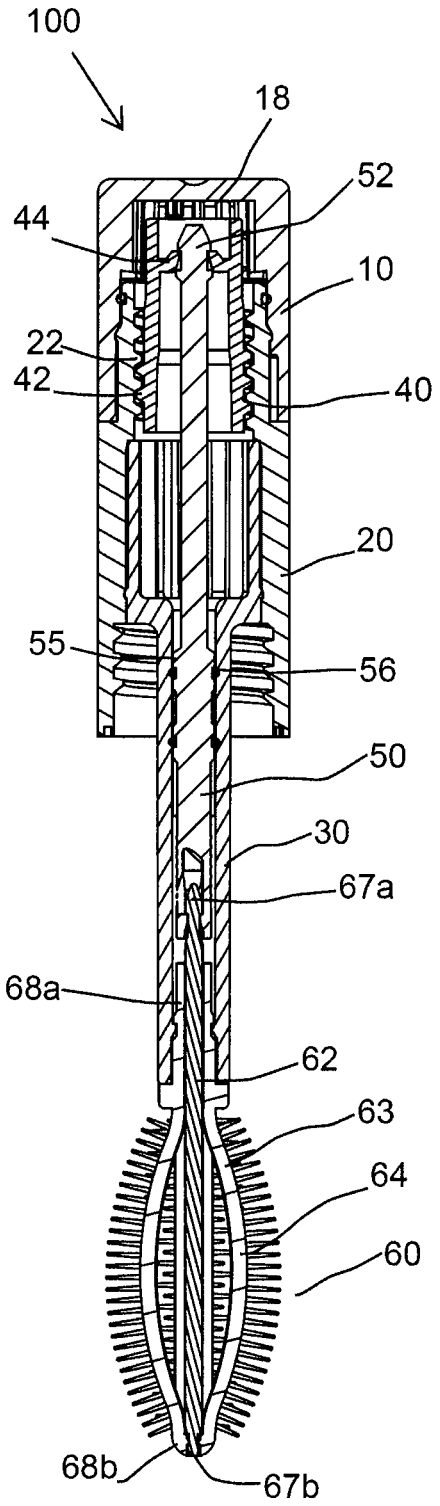
FIG. 4 illustrates a cross-sectional view taken along an axis B-B of the adjustable applicator of FIG. 3.

The applicator head 60 can adopt at least two configurations that is to say a first configuration as shown in FIGS. 1 and 2, and a second configuration as shown in FIGS. 3 and 4. In the first configuration, each of the at least two applicator members 62, 64 extends along a central longitudinal axis X-X of the adjustable applicator 100 and the applicator head 60 is in a radially retracted position. In the second configuration as shown in FIGS. 3 and 4, the applicator head 60 is in a radially extended position. In the second configuration, the applicator head 60 is radially deformed and overall height of the applicator head 60 is reduced. More particularly, in the second configuration, at least one of the applicator members 62, 64 of the applicator head 60 is radially deformed.

Referring to FIGS. 6A-9, each of the at least two applicator members 62, 64 comprises a support body 62*a*, 64*a* respectively having an outer surface facing away from the central longitudinal axis X-X. A plurality of application elements 62*b* and 64*b* extend out from the outer surface of the support body 62*a* and 64*a* of the first and second applicator members 62, 64 respectively.

Figure 12:
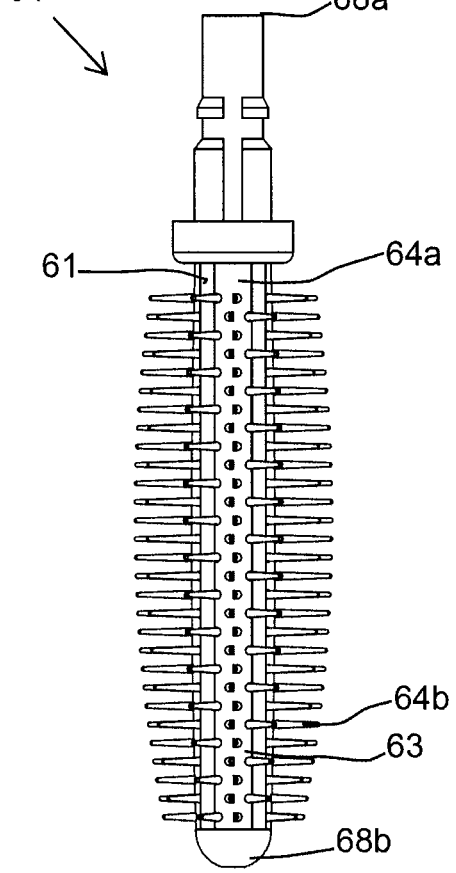
FIG. 12 illustrates a front view of a second applicator member of the adjustable applicator of FIG. 1.
Figure 13:
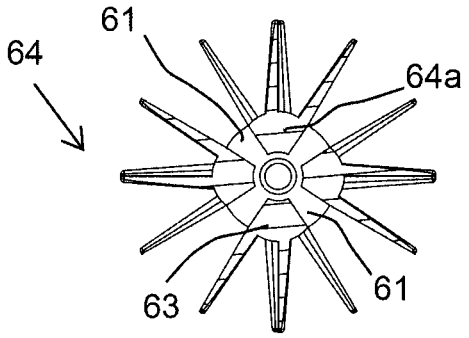
FIG. 13 illustrates a transverse cross-sectional view of the second applicator member of FIG. 12.
Figure 15:
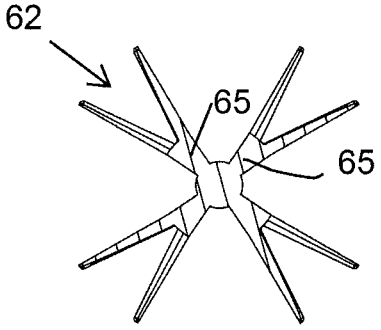
FIG. 15 illustrates a transverse cross-sectional view of the first applicator member of FIG. 14.

As shown in FIGS. 12 & 13, the support body 64*a* of the second applicator member 64 is tubular body with a hollow interior. The second applicator member 64 has a proximal end 68*a* and a distal end 68*b*. Further, the support body 64*a* includes a plurality of spaced parallel slots 61 extending substantially longitudinally thereon to define at least two longitudinal strips 63 having application elements 64*b* thereon. The at least two longitudinal strips 63 are arranged along the central longitudinal axis X-X but in other alternate embodiments, the at least two longitudinal strips 63 may be arranged at an angle with the central longitudinal axis X-X or may form a spiral around the central longitudinal axis X-X.

Figure 14:
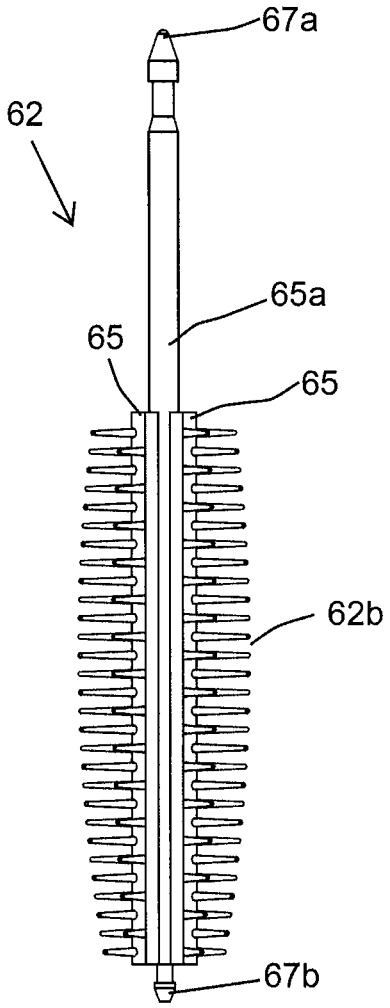
FIG. 14 illustrates a front view of a first applicator member of the adjustable applicator of FIG. 1.

As seen in FIGS. 6A-9, the first applicator member 62 is mounted concentrically within the hollow interior of the second applicator member 64 so as to expose the application elements 62*b*, 64*b* of each of the applicator members 62, 64. More specifically, as illustrated in FIG. 14, the first applicator member 62 has an elongated body 65*a* having a proximal end 67*a* and a distal end 67*b*. The first applicator member 62 further comprises at least two longitudinal projecting strips 65 projecting from the elongated body 65*a*, wherein each of the at least two longitudinal projecting strips 65 has at least one row of the application elements 62*b* thereon. The at least two longitudinal projecting strips 65 are arranged along the central longitudinal axis X-X but in other alternate embodiments, the at least two longitudinal projecting strips 65 may be arranged at an angle with the central longitudinal axis X-X or may form a spiral around the central longitudinal axis X-X.

Figures 6A, 6B:
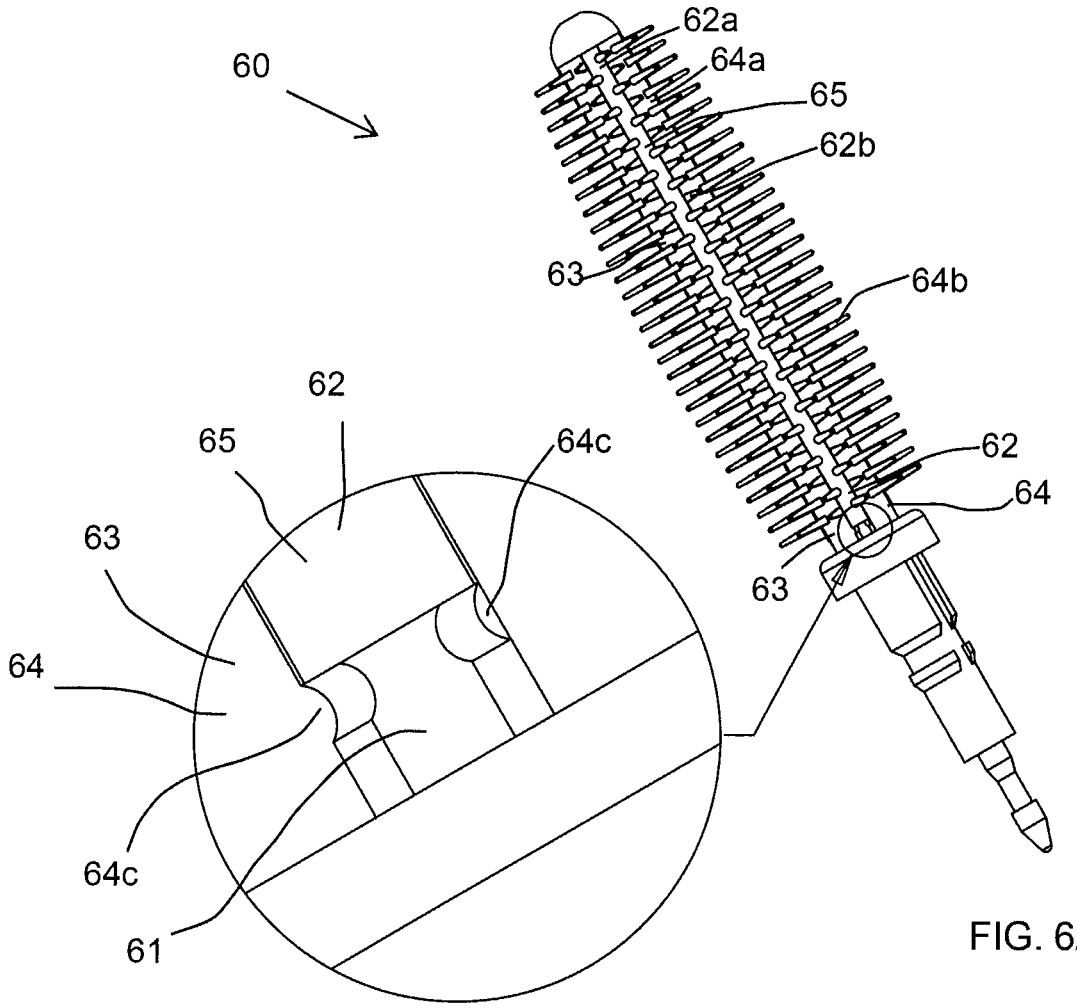
FIG. 6A illustrates a perspective view of an applicator head of the adjustable applicator of FIG. 1.
FIG. 6B illustrates an enlarged view of a portion of the applicator head of FIG. 6A.
Figure 10:
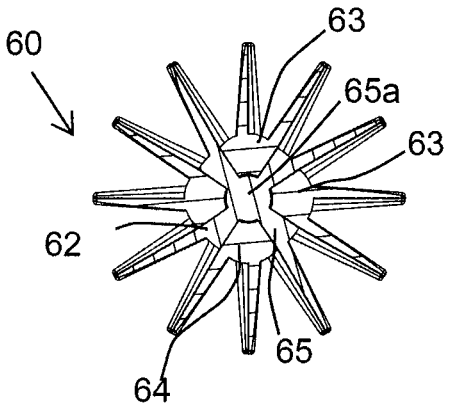
FIG. 10 illustrates a transverse cross-sectional view of the applicator head of FIG. 6A.
Figure 11:
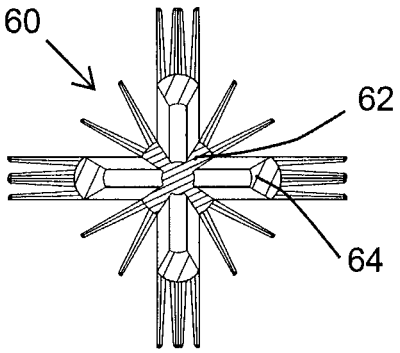
FIG. 11 illustrates a transverse cross-sectional view of the applicator head of FIG. 7.

The projecting strips 65 have a shape corresponding to the slots 61 of the second applicator member 64 so that when the first applicator member 62 is mounted coaxially within the hollow interior of the second applicator member 64, the projecting strips 65 are placed in the respective slots 61 such that the projecting strips 65 of the first applicator member and the strips 63 of the second applicator member 64 together form a smooth and contiguous outer surface of the applicator head 60 in the first configuration (See FIGS. 1 & 6A). As shown in FIG. 6A, the applicator members 62 and 64 are so arranged to expose the application elements 62*b*, 64*b* of each of the applicator members 62, 64 in an alternate fashion, i.e. at least one row of the application elements 62*b* of the applicator member 62 are placed adjacent to the at least one row of application elements 64*b* of the applicator member 64 in alternate fashion. In other words, the strips 63 of the second applicator member 64 alternate with projecting strips 65 of the first applicator member 62 around the central longitudinal axis X-X of the applicator head 60 (see FIG. 10).

According to this embodiment, the number of strips 63 of the second applicator member 64 is four but may, of course, be subject to many variations. Thus, the number of strips 63 may be two or higher than two, for instance, four, six, eight or any other number. The shape and disposition of the application elements 62*b*, 64*b* can obviously be altogether different.

The application elements 62*b*, 64*b* may be chosen from a group of application elements consisting of bristles, teeth, discs, ribs, and flocking.

The two applicator members 62, 64 are fixed to each other at their distal ends 67*b*, 68*b*. In the embodiment shown in FIGS. 8 & 9, the distal ends 67*b*, 68*b* of applicator members 62, 64 are fixed to each other through snap fitment. In other embodiments, the distal ends 67*b*, 68*b* of the first and second applicator members 62, 64 respectively may be directly connected to each other by screw, adhesive, bi-injection method or any other connecting means known in the art. In other alternate embodiment, where the distal ends 67*b*, 68*b* of the first and second applicator members are indirectly connected to one another via a third part is also contemplated.

According to a further aspect of the present embodiment, the distal ends 67*b*, 68*b* of the first applicator member 62 and the second applicator member 64 do not have axial movement relative to each other, i.e. they are fixed to one another in such a manner that the distal ends 67*b*, 68*b* of the first applicator member 62 and the second applicator member 64 do not move independently of each other. However, the proximal ends 67*a*, 68*a* of the first applicator member 62 and the second applicator member 64 have axial movement relative to each other, more particularly, the proximal end 67*a* of the first applicator member 62 is axially movable and the proximal end 68*a* of the second applicator member 64 is fixed so that it cannot move axially.

As seen in FIGS. 1-4, the two applicator members 62, 64 are arranged to be movable relative to each other wherein the relative movement of the applicator members 62, 64 results in radial deformation of one of the applicator members 62, 64. More specifically, when the proximal end 67*a* of the first applicator member 62 is moved axially towards a proximal end of the adjustable applicator 100, the distal end 68*b* of the second applicator member 64 and the distal end 67*b* of the first applicator member 62 are pulled towards the proximal end of the adjustable applicator 100. As the proximal end 68*a* of the second applicator member 64 is fixed, the proximal end 68*a* does not move axially with distal end 68*b*, which results in radial deformation of the second applicator member 64 due to compression stress exerted on it. Thus, the second applicator member 64 is movable from a radially retracted position to a radially extended position. The second applicator member 64 is in the radially extended position when the first applicator member 62 is moved axially towards the proximal end of the adjustable applicator 100 (FIG. 4). The second applicator member 64 is in the radially retracted position when the first applicator member 62 is moved axially towards a distal end of the adjustable applicator 100 (FIG. 2). More specifically, at least one strip 63 of the second applicator member 64 is movable from a radially retracted position to a radially extended position by the action of axial force acting upon the second applicator member 64 (See FIG. 4). A distance in radial direction between the first and second applicator member 62, 64 is greater in the radially extended position of the second applicator member 64 than in the radially retracted position of the second applicator member 64. Furthermore, the at least one strip 63 of the second applicator member 64 is deformed radially outward to separate from the strip 65 of the first applicator member 62.

According to preferred embodiment, the second applicator member 64 is made of a material softer than the material of the first applicator member 62. Preferably, the second applicator member 64 is flexible and made of an elastomeric material. The first applicator member 62 may be made from a harder plastic, metal, ceramic or similar type of material.

Referring to FIGS. 1-4, the mechanism employed for axial movement of the first applicator member 62 will be explained in detail. As shown, the proximal end 67*a* of the first applicator member 62 is connected to a distal end 54 of an axially movable inner rod 50, whereas the proximal end 68*a* of the second applicator member 64 is fixed to a distal end 34 of the hollow stem 30, the stem 30 being not axially movable. The hollow stem 30 includes a cavity which houses the movable inner rod 50. The adjustable applicator 100 also includes the actuator 10 and the movable member 40 and wherein, the rotation of actuator 10 causes the axial displacement of the movable member 40. The actuator 10 as shown in the FIGS. 1-4, is a dialer, however, the actuator 10 may be a slider, a button or any other suitable actuator which causes axial movement of the first applicator member 62. According to present embodiment, the cap 20 is attached with the actuator 10 such that the cap 20 is free to rotate relative to the actuator 10 via a snap-fit system comprising an internal annular groove 16 on the actuator 10 that engages with a complementary external annular protrusion 28 on the cap 20. The actuator 10 can thus be turned by the user relative to the cap 20. However, any suitable engagement means may be employed that allows relative rotation between the actuator 10 and cap 20.

Further, a lower portion of the cap 20 is non-rotatably connected to a proximal portion of the stem 30. As seen in FIGS. 2 and 4, the stem 30 may be attached to the cap 20 by snap-fitment or by any other engaging means known in the art. Further, for non-rotatably locking the stem 30 with the cap 20, there may be provided on the interfaces where the stem 30 is joined to the cap 20, complementary longitudinal protrusions and positioning longitudinal grooves. For example as seen in FIG. 5, an outer surface of the stem 30 includes a plurality of longitudinal protrusions 31 which are arranged to become in mating engagement with complementary grooves (not shown) present at an inner surface of the cap 20 or vice versa, for non-rotatable engagement. However, it would not be beyond the ambit of the present disclosure that any other non-rotatable engagement known in the art may be employed for locking any relative rotation between the stem 30 and the cap 20. According to alternate embodiments, the stem 30 and the cap 20 may be integrally molded.

As represented by FIGS. 2 and 4, the movable member 40 is rotatably connected to the cap 20 by a threaded arrangement. An upper portion of the cap 20 has internal threads 22 to connect to outer threads 42 of the movable member 40. Movable member 40 is connected to the actuator 10 in a manner such that axial movement of the movable member 40 is allowed but rotational movement with respect to the actuator 10 is prohibited. The actuator 10 includes longitudinal guide protrusions 18 at its inner surface for guiding axial movement of the movable member 40 and for preventing movable member 40 from rotating with respect to the actuator 10, when the actuator 10 is rotated. The movable member 40 includes a catch 44 which holds a proximal end 52 of the inner rod 50. When the actuator 10 is rotated, the movable member 40 rotates with respect to cap 20 and moves axially due to screw engagement with the cap 20. The inner rod 50 and the first applicator member 62 are also displaced axially with the movable member 40 since inner rod 50 is held by the movable member 40. Thus, when the actuator 10 is actuated by rotation in first direction about a longitudinal axis X, the movable member 40 also rotates along with the actuator 10 and moves up on the threads of cap 20 as shown and thereby results in the upward movement of the inner rod 50 in the longitudinal direction. The movement of inner rod 50 in the longitudinal direction results in the displacement of the applicator member 62 in the longitudinal direction, and the applicator member 62 is pulled along the distal end 68*b* of the second applicator member 64 to decrease the overall height of the applicator head 60 and which also results in radial extension of the second applicator member 64 which further produces a pronounced increase in a diameter of the applicator head 60. In the radially retracted position, the applicator head 60 has a first maximum diameter and in the radially extended position the applicator head 60 has a second maximum diameter which is greater than the first maximum diameter. The diameter increase is at its maximum approximately midway along the second applicator member 64. The applicator head 60 achieves the second configuration which corresponds to radially extended position of the second applicator member 64. The application in this state of the applicator head gives a better separation and curling in case of mascara application on eyelashes of a user. According to other embodiments, the diameter increase may be at its maximum at any point along a length of the applicator member 64.

The actuator 10 when rotated in a second direction reverse to the first direction brings the applicator head 60 to its initial first configuration which corresponds to radially retracted position of the second applicator member 64. It will thus be understood that the applicator 100 may be used by a person either in the minimum diameter configuration shown in FIG. 2, or in the maximum diameter configuration shown in FIG. 4. If the user wishes to return from the FIG. 3 position to that of FIG. 1, the user only has to rotate the actuator so that the inner rod 50 moves downwards and the applicator member 64 resume its elongated and radially retracted position with initial diameter.

According to another aspect of the present disclosure, the inner rod 50 is connected to the movable member in a way that when the movable member 40 rotates with respect to the cap 20, the inner rod 50 does not rotate along with the movable member 40. In an alternate embodiment, the inner rod 50 is connected to the movable member in a way that when the movable member 40 rotates with respect to the cap 20, the inner rod 50 also rotates along with the movable member 40.

According to yet another aspect of the present disclosure, the inner rod 50 and first applicator member 62 may be formed integrally.

According to yet another aspect of the present disclosure, the stem 30 and the second applicator member 64 may be formed integrally.

According to another aspect of the present disclosure, when the actuator 10 is rotated with respect to the cap 20, the inner rod 50 moves longitudinally with respect to the stem 30 which causes variation in the profile of the applicator head 60 as explained above. When a suitable adjustment of the profile of the applicator head 60 has been made it will be retained while the applicator head 60 is used. The adjustment is retained until the user intentionally rotates the actuator 10 and the cap 20 with respect to each other once again to achieve a different adjustment.

According to yet another embodiment of the present disclosure, the inner rod 50 and the stem 30 may have a circular or a non-circular transverse cross-sections.

According to yet another embodiment of the present disclosure, for example, as seen in FIGS. 2, 4 and 5, one or more annular ribs 55 and sealing O-rings 56 are configured around the inner rod 50 so that the inner rod 50 interfaces tightly against an inner wall of the stem 30 (see FIG. 2). The annular ribs 55 and the sealing O-rings 56 prevent the product P from leaking and ensure steady, smooth, and noiseless extension of the inner rod 50 along the stem 30.

Figure 7:
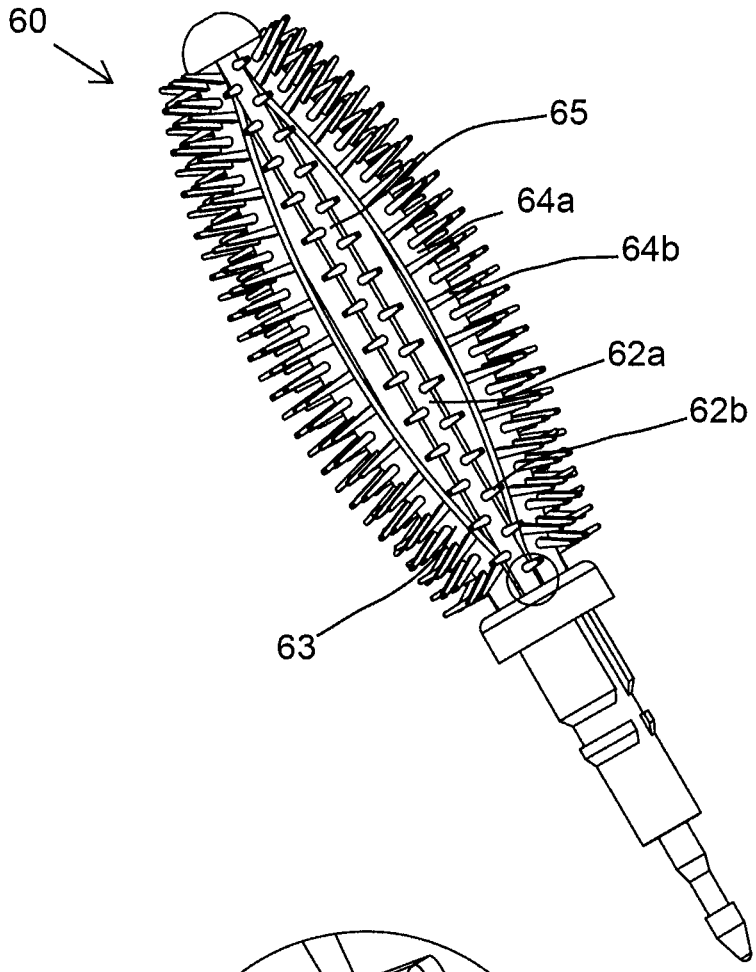
FIG. 7 illustrates a perspective view of an applicator head of FIG. 4.
Figure 7A:
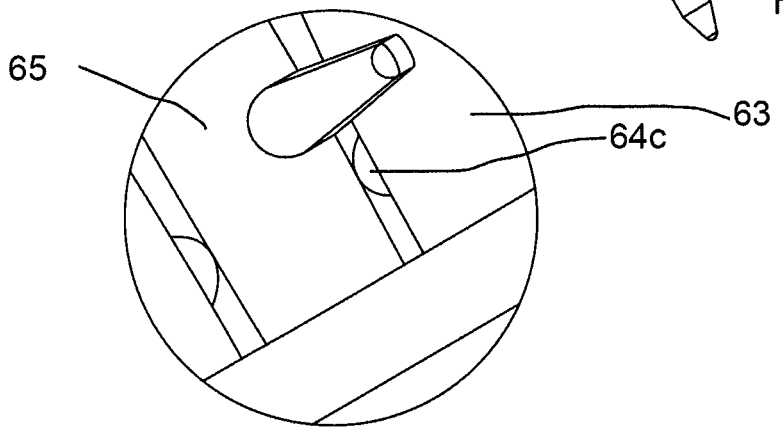
FIG. 7A illustrates an enlarged view of a portion of the applicator head of FIG. 7.
Figure 8:
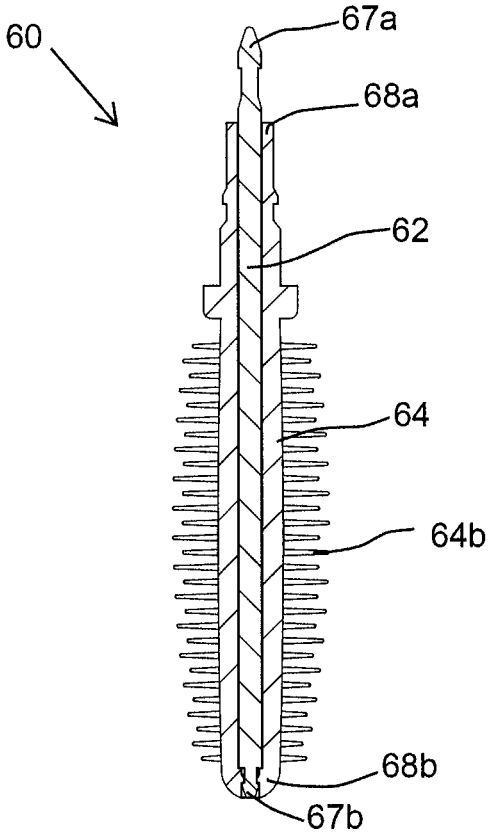
FIG. 8 illustrates a cross-sectional view of the applicator head of FIG. 6A.
Figure 9:
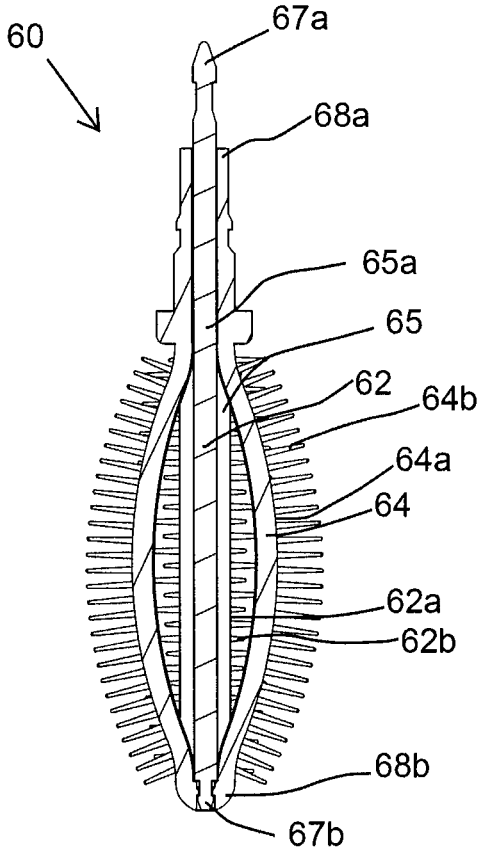
FIG. 9 illustrates a cross-sectional view of the applicator head of FIG. 7.

According to yet another embodiment of the present disclosure, as seen in FIGS. 6A and 6*b*, at least one longitudinal strip 63 of the second applicator member 64 includes at least one protrusion 64*c* that projects in the slot 61 adjacent to the at least one protrusion 64*c* so that when a compression stress is exerted on the second applicator member 64 when the first applicator member 62 is displaced axially towards the proximal end of the adjustable applicator 100, a mechanical interference between the first and the second applicator member 62, 64 is generated. The mechanical interference produces a resultant force in radial direction on the second applicator member 64, which guarantees the separation between the longitudinal strips 63 and the projecting strips 65 of the second and the first applicator members 64, 62 respectively in radial orientation/direction in spite of being impregnated by a cosmetic product. In the first configuration, the at least one protrusion 64*c* is located below a proximal end of at least one of the at least two projecting strips 65 of the first applicator member 62 (see FIG. 6B); and in the second configuration of the applicator head, the at least one protrusion 64*c* is located laterally to the at least one of the at least two projecting strips 65 of the first applicator member 62 (see FIG. 7A).

Figure 16:
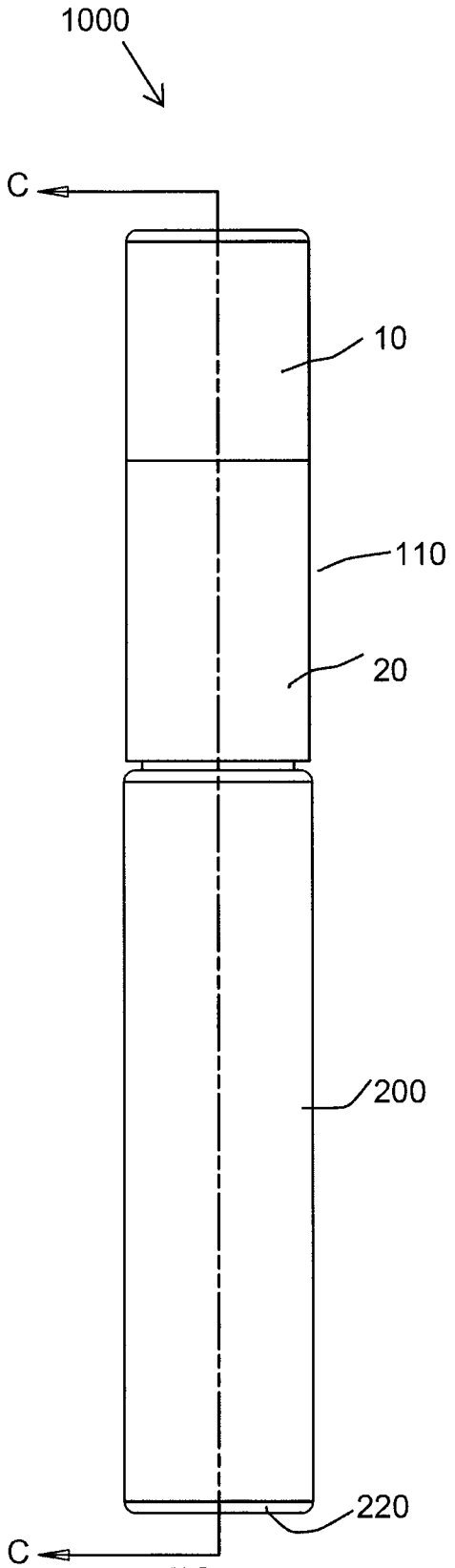
FIG. 16 illustrates a front view of a cosmetic package in closed condition equipped with the adjustable applicator of FIG. 1.
Figure 17:
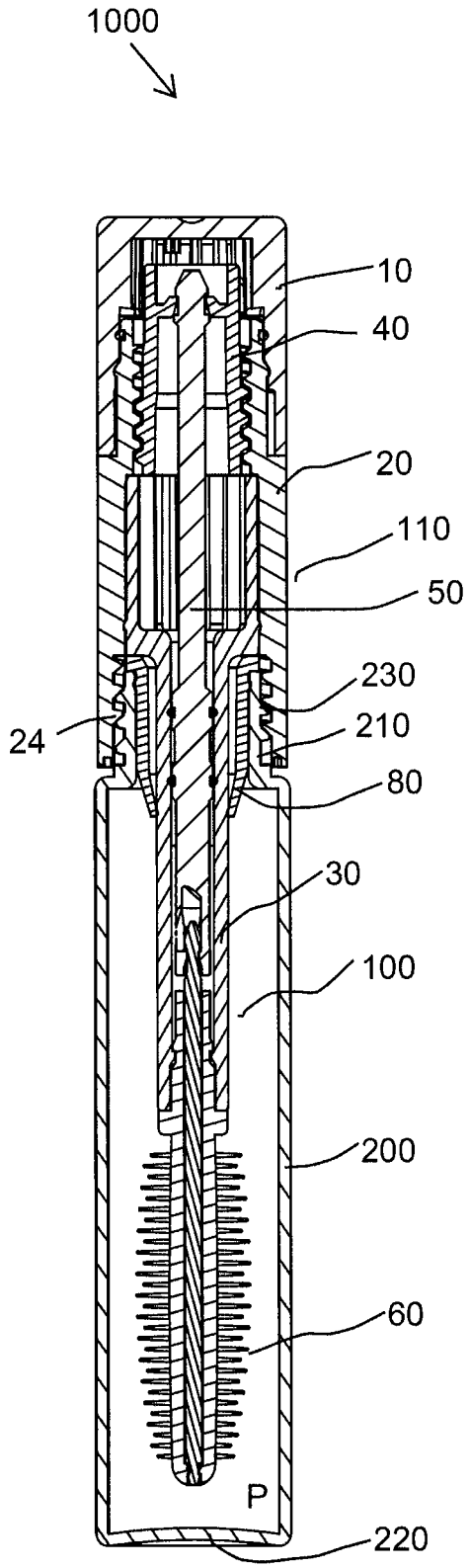
FIG. 17 illustrates a cross-section view taken along an axis C-C of the cosmetic package of FIG. 16.

FIGS. 16 and 17 illustrate a container 1000 in closed position with respect to one embodiment of the present disclosure. As embodied herein and shown in the FIGS. 16 and 17, the container 1000 comprises a receptacle 200 and the adjustable applicator 100 as described above. The receptacle 200 is of cylindrical cross section extending in the longitudinal direction; however, the receptacle 200 can take any suitable shape. As shown in FIGS. 16 and 17, the receptacle 200 is closed by a gripping member 110 by way of a threaded arrangement; however, any other suitable lock and key arrangement may be used to close the receptacle 200. The actuator 10, the gripping member 110 and the receptacle 200 are of substantially same cross section so as to align along a common axis when fastened to each other in the closed position of the container 1000.

The gripping member 110 includes the actuator 10 and the cap 20. The applicator head 60 is secured to the stem 30 and intended for being inserted in said receptacle 200 in order to be loaded with a product P to be applied.

As shown in FIGS. 16 and 17, the receptacle 200 has a closed end 220 and an open end in the form of a neck 210 thereby defining a cavity for holding the product P. The neck 210 of the receptacle 200 is provided with an external thread 230 intended for cooperating with a complementary internal thread 24 carried by the cap 20 in its lower portion, allowing the receptacle 200 to be closed by screwing.

For some cosmetic products, such as mascara or a lip gloss, it is preferable to provide a wiper 80 positioned into the neck 210 of the receptacle 200 to wipe excess product P from the adjustable applicator 100 as the adjustable applicator 100 is withdrawn from the receptacle 200. The wiper 80 is preferably made of an elastomeric plastic material. The wiper 80 may be one time snap fitted to the neck 210 of the receptacle 200, however, the wiper 80 may be fitted onto the neck 210 of the receptacle 200 by any other suitable arrangement.

A user may utilize the container 1000 as described in above embodiments for application of a product. Moreover, the adjustable applicator 100 of the container 1000 allows the user to vary the profile of the applicator head 60.

The materials suitable for forming the receptacle 200, the inner rod 50, the cap 20, actuator 10, stem 30 and the movable member 40 may be formed of plastic material such as polypropylene, acrylonitrile butadiene styrene, polyacetal or any other suitable polymeric material. In alternate embodiments, the receptacle may be made of glass or metal. In alternate embodiments, the inner rod 50 may be made of metal, alloy or ceramic material. The material for forming the wiper 80 could be low-density polyethylene. The aforementioned materials for forming various parts of the container of the present disclosure are an example, however other suitable materials may also be used. Depending upon the substance being used in the receptacle, a variety of sizes and shapes of the applicator heads/members can be utilized. It could have a shape other than cylindrical such as ovular, tapered or any other suitable shape.

Although the above description and drawings show the container being cylindrical, the shapes and profile cross section thereof are not limited to the same.

Accordingly, the appended claims should be construed to encompass not only those forms and embodiments of the disclosure specifically described above, but to such other forms and embodiments as may be devised by those skilled in the art without departing from its true spirit and scope.

What is claimed is:

1. An adjustable applicator comprising:

an applicator head comprising at least two applicator members;

wherein the at least two applicator members comprise a first applicator member and a second applicator member;

wherein the first applicator member has a first proximal end and a first distal end and the second applicator member has a second proximal end and a second distal end, wherein the first and second distal ends are fixed relative to each other;

wherein each of the first applicator member and the second applicator member comprises a support body;

wherein the support body of the first applicator member comprises four longitudinal projecting strips and the support body of the second applicator member comprises four longitudinal strips including an outer surface facing away from a central longitudinal axis of the applicator head;

wherein a plurality of application elements extends out from the outer surface of the support body of each of the first applicator member and the second applicator member;

wherein the first applicator member is mounted at least in part within a hollow interior of the second applicator member, each of the plurality of longitudinal projecting strips being positioned in one of four slots of the second applicator member each slot defined between two different longitudinal strips of the four longitudinal strips;

wherein the distal ends of the first applicator member and the second applicator member are fixed to one another in the hollow interior of the second applicator member such that the distal ends of the first applicator member and the second applicator member do not move independently of each other;

wherein the second applicator member is capable of assuming at least a first configuration and a second configuration, and wherein the first configuration corresponds to a radially retracted position of the second applicator member and the second configuration corresponds to a radially extended position of the second applicator member wherein a plurality of protrusions of each one of the four longitudinal strips of the second applicator member extends into a respective one of the slots when the first applicator member is displaced axially toward a proximal end of the adjustable applicator to create a mechanical interference wherein in the radially retracted position of the second applicator member, the applicator head has a first maximum diameter and in the radially extended position of the second applicator member, the applicator head has a second maximum diameter; and wherein the second maximum diameter is greater than the first maximum diameter.

2. The adjustable applicator of claim 1, wherein in the second configuration, an overall height of the applicator head is reduced.

3. The adjustable applicator of claim 1, wherein the second maximum diameter is located at approximately midway along the applicator head.

4. The adjustable applicator of claim 3, wherein a deformation of the applicator head from the radially extended position to the radially retracted position and vice versa is due to a relative axial movement of the first applicator member and the second applicator member with respect to each other.

5. The adjustable applicator of claim 4, wherein when the proximal end of the first applicator member is moved axially towards a proximal end of the adjustable applicator, the distal ends of the first applicator member and the second applicator member are axially displaced towards the proximal of the adjustable applicator, but the proximal end of the second applicator member is fixed and does not displace axially, which results in radial deformation of the second applicator member.

6. The adjustable applicator of claim 5, wherein the support body of the first applicator member comprises an elongated body and the four longitudinal projecting strips projecting from the elongated body, and wherein one of the four longitudinal projecting strips has at least one row of the plurality of application elements on the outer surface; and wherein the support body of the second applicator member comprises a tubular body having the four slots that extend longitudinally and define the four longitudinal strips with the plurality of application elements on the outer surface of the support body.

7. The adjustable applicator of claim 6, wherein the four longitudinal projecting strips of the first applicator member have a shape corresponding to the slots of the second applicator member.

8. The adjustable applicator of claim 7, wherein the four longitudinal projecting strips of the first applicator member and the four longitudinal strips of the second applicator member together form a smooth and contiguous outer surface of the applicator head in the first configuration of the applicator head.

9. The adjustable applicator of claim 8, wherein in the second configuration, one of the four longitudinal strips of the second applicator member is deformed radially outward to separate from the four longitudinal projecting strips of the first applicator member so as to form a non-contiguous outer surface of the applicator head.

10. The adjustable applicator of claim 1, wherein the first applicator member and second applicator member are so arranged to expose the plurality of application elements of each of the first applicator member and the second applicator member in an alternate fashion.

11. The adjustable applicator of claim 1, wherein the plurality of application elements are chosen from a group of application elements consisting of bristles, teeth, discs, ribs and flocking.

12. The adjustable applicator of claim 1, wherein the adjustable applicator further comprises an actuator, a cap, a hollow stem, a movable member, and an inner rod.

13. The adjustable applicator of claim 12, wherein the proximal end of the first applicator member is connected to a distal end of the inner rod, whereas the proximal end of the second applicator member is fixed to a distal end of the hollow stem and wherein actuation of the actuator causes axial displacement of the movable member, the inner rod and the first applicator member.

14. The adjustable applicator of claim 13, wherein the actuator is rotatable in a first direction and a second direction reverse to the first direction to bring the applicator head to the second configuration and the first configuration respectively.

15. An adjustable applicator comprising:

an applicator head comprising at least two applicator members;

wherein the at least two applicator members comprise a first applicator member and a second applicator member;

wherein the applicator head is capable of assuming at least a first configuration and a second configuration;

wherein the first applicator member has a first proximal end and a first distal end and the second applicator member has a second proximal end and a second distal end, wherein the first and second distal ends are fixed relative to each other in a hollow interior of the second applicator member;

wherein each of the first applicator member and the second applicator member comprises a support body;

wherein the support body of each of the first applicator member and the second applicator member includes an outer surface facing away from a central longitudinal axis of the applicator head;

wherein the support body of the first applicator member comprises an elongated body and at least two longitudinal projecting strips projecting from the elongated body;

wherein at least one of the at least two longitudinal projecting strips of the first applicator member has at least one row of application elements;

wherein the support body of the second applicator member comprises a tubular body having a plurality of slots that extend longitudinally to define at least two longitudinal strips between them;

wherein one of the at least two longitudinal strips of the second applicator member has at least one row of application elements;

wherein the at least two longitudinal projecting strips of the first applicator member have a shape corresponding to the slots of the second applicator member; and wherein each of the at least two longitudinal strips of the second applicator member includes a plurality of protrusions extending into each respective one of the slots in the second applciator member, wherein a compression stress is exerted on the second applicator member when the first applicator member is displaced axially towards the proximal end of the adjustable applicator, a mechanical interference between the first and the second applicator member is generated.

16. The adjustable applicator of claim 15, wherein the first configuration corresponds to a radially retracted position of the applicator head and the second configuration corresponds to a radially extended position of the applicator head; and wherein in the second configuration, the at least two longitudinal strips of the second applicator member are deformed radially.

17. The adjustable applicator of claim 16, wherein in the first configuration, at least one protrusion of the plurality of protrusions is located below a proximal end of one of the at least two projecting strips of the first applicator member.

18. The adjustable applicator of claim 16, wherein in the second configuration, at least one protrusion of the plurality of protrusions is located laterally to the at least two projecting strips of the first applicator member.

19. An adjustable applicator comprising:

an applicator head comprising at least two applicator members;

wherein the at least two applicator members comprise a first applicator member and a second applicator member;

wherein the first applicator member has a first proximal end and a first distal end and the second applicator member has a second proximal end and a second distal end;

wherein each of the first applicator member and the second applicator member comprises a support body;

wherein the support body of the first applicator member comprises an elongated body and at least two longitudinal projecting strips projecting from the elongated body;

wherein at least one of the at least two longitudinal projecting strips of the first applicator member has at least one row of application elements;

wherein the support body of the second applicator member comprises a tubular body with a hollow interior and having a plurality of slots that extend longitudinally to define at least two longitudinal strips between them;

wherein one of the at least two longitudinal strips of the second applicator member has at least one row of application elements;

wherein the at least two longitudinal projecting strips of the first applicator member have a shape corresponding to the slots of the second applicator member;

wherein the first applicator member is mounted at least in part within the hollow interior of the second applicator member;

wherein the distal ends of the first applicator member and the second applicator member are fixed to one another in such a manner that the distal ends of the first applicator member and the second applicator member do not move independently of each other and are fixed relative to each other in the hollow interior of the second applicator member;

wherein the second applicator member is capable of assuming at least a first configuration and a second configuration, and wherein the first configuration corresponds to a radially retracted position of the second applicator member and the second configuration corresponds to a radially extended position of the second applicator member wherein a plurality of protrusions for each one of the at least two longitudinal strips extends into a respective one of the slots when the first applicator member is displaced axially toward a proximal end of the adjustable applicator; and wherein in the second configuration, one of the at least two longitudinal strips of the second applicator member is deformed radially outward to separate from the at least two longitudinal projecting strips of the first applicator member.

20. The adjustable applicator of claim 19, wherein the at least two longitudinal strips of the second applicator member are arranged along a central longitudinal axis; or wherein the at least two longitudinal strips are arranged at an angle with the central longitudinal axis; or wherein the at least two longitudinal strips may form a spiral around the central longitudinal axis.

* * * * *